US011780540B2

(12) United States Patent
Berner

(10) Patent No.: US 11,780,540 B2
(45) Date of Patent: Oct. 10, 2023

(54) HOLDER ADAPTABLE TO PERSONAL WATERCRAFT

(71) Applicant: Jeffrey D. Berner, Hilton, NY (US)

(72) Inventor: Jeffrey D. Berner, Hilton, NY (US)

( * ) Notice: Subject to any disclaimer, the term of this patent is extended or adjusted under 35 U.S.C. 154(b) by 361 days.

(21) Appl. No.: 17/235,149

(22) Filed: Apr. 20, 2021

(65) Prior Publication Data

US 2022/0332393 A1 Oct. 20, 2022

(51) Int. Cl.
*B63B 34/26* (2020.01)

(52) U.S. Cl.
CPC ..... *B63B 34/26* (2020.02)

(58) Field of Classification Search
CPC ..... B63B 34/26
See application file for complete search history.

(56) References Cited

U.S. PATENT DOCUMENTS 5,605,112 A * 2/1997 Schuman ..... B63C 13/00 224/406
5,941,434 A * 8/1999 Green ..... A45F 5/02 224/195
5,996,527 A * 12/1999 Ambrozic ..... A01K 97/10 114/364
6,050,213 A * 4/2000 Stevens ..... B63B 17/00 114/364
6,840,190 B2 * 1/2005 Godek ..... B63B 34/26 114/347
6,964,243 B1 * 11/2005 Thompson ..... B63B 34/20 114/347
7,032,531 B1 * 4/2006 Caples ..... B63B 19/14 114/347
9,586,657 B1 * 3/2017 Dykes ..... A47B 3/10

* cited by examiner

*Primary Examiner* — S. Joseph Morano
*Assistant Examiner* — Jovon E Hayes
(74) *Attorney, Agent, or Firm* — Jong Patent Firm; Cheng Ning Jong; Tracy P. Jong

(57) ABSTRACT

A holder for supporting at least one equipment, the holder configured to be secured to a top surface of a watercraft without requiring modifications to the watercraft, the holder including a plate including at least two anchors; at least two ties, each connecting one of the at least two anchors to a portion of the watercraft, securing the plate to the watercraft; and at least one receptacle disposed on the plate, the receptacle configured for receiving the at least one equipment.

18 Claims, 14 Drawing Sheets

HOLDER ADAPTABLE TO PERSONAL WATERCRAFT

BACKGROUND OF THE INVENTION

1. The Field of the Invention

The present invention relates to an equipment holder adaptable to watercraft. More specifically, the present invention is directed to an equipment holder adaptable to a kayak or a paddleboard.

2. Background Art

Kayakers and paddleboard users are often faced with the lack of suitable attachment locations on kayaks and paddleboards to mount imaging devices, e.g., cameras, video cameras, mobile devices, e.g., phones and Global Positioning System (GPS) devices, etc. Although such devices may be secured by means of mounting hardware to a kayak cockpit rim, the views obtained from the imaging devices may not be suitable or desired, especially if forward-facing views are desired as the user's arms or paddle may interfere with the front facing imaging devices. Further, cockpit-mounted parts or assemblies may not only intrude into the kayaker's space, they may also limit the range of motion of the kayaker. Such parts or assemblies may even be a safety hazard as the kayaker may get entangled by the additional cockpit-mounted parts or assemblies. Forward or aft decks of a kayak are typically equipped with a webwork of elastic and static cordage or deck lines of rigging of various lengths and connections for aiding the user in capsize and/or rescue situations or to provide grab-holds and to secure gear to the decks. Various devices have been attempted to allow various equipment to be secured to a watercraft.

U.S. Pat. No. 6,964,243 to Thompson (hereinafter Thompson) discloses a water-tight, streamlined storage pack, removably attached to a kayak deck and accessible by a kayak operator during kayak operation. Thompson's pack also provides lighting and fishing rod holders. Thompson discloses a storage pack that is also securable to the deck rigging area of a kayak with straps and a bottom surface of the pack that is curved to accommodate a curved forward or a rearward deck. Thompson's pack is rather large, substantial and includes a housing and may significantly affect the dynamics and maneuverability of the kayak to which it is attached. Further, the curvature of the bottom surface may result in the storage pack not having sufficient contact surface while mounted to a kayak deck having a curvature that differs from the curvature of the bottom surface of Thompson's pack.

U.S. Pat. No. 5,605,112 to Schuman (hereinafter Schuman) discloses a durable gear bag designed for use in white water rafts and other small watercraft. Heavy weight polypropylene webbing is sewn along the bottom of the bag. D-rings are attached to extensions of the webbing. The bag is then attached to the D-rings of a raft using common boat straps. The bag/strap configuration permits many different strapping arrangements for use in a variety of watercraft. The top of the bag is fitted with strips of common hook and loop fasteners. These strips are sealed and rolled down snugly.

Three snap release connectors are then used to secure the top of the bag. When not in use, the bag can be folded or stuffed for easy packing. Schuman discloses a bag securable with webbing straps terminated with D-rings to a watercraft. Again, Schuman's bag is rather large, substantial and includes a bag or enclosure and may significantly affect the dynamics and maneuverability of a kayak to which it is attached. No considerations were given to the curvature of the bottom surface of the bag to ensure that the bag can be securely held on the surface of a kayak or another watercraft.

U.S. Pat. No. 9,586,657 to Dykes (hereinafter Dykes) discloses folding tables for use on small boats like kayaks and canoes, including inflatable kayaks. Such tables are secured to the gunwales or topsides of such small boats and have various devices for organizing and securing sportsman's gear for fishing, hunting, photographing and the like. The tables are readily detachable from the boats and foldable for compact storage. Dykes' table is a folding table including two hinged flat panels. No thought was given to making the table concaved to suit a kayak's deck.

U.S. Pat. No. 6,840,190 to Godek (hereinafter Godek) discloses a kayak cooler having an enclosure with a rigid outside surface and a contoured bottom. The kayak cooler has a plurality of securing tabs disposed about the rigid outside surface of the enclosure. The enclosure has a top with an access opening and the contoured bottom has a shape approximating the contour of a foredeck of a kayak. Godek discloses an enclosure having a contoured bottom such that the enclosure can be disposed atop the kayak deck. Again, Godek's bag is rather large, substantial and includes an enclosure and may significantly affect the dynamics and maneuverability of a kayak to which it is attached.

U.S. Pat. No. 5,941,434 to Green (hereinafter Green) discloses a holder/carrier temporarily attaches to and supports small items of multiple configurations. Using multiple, flexible straps that are each attached to a support base, the item is enwrapped and retained against the support base. An attachment mechanism, such as a retaining clip, is affixed to the support base, and is utilized to selectively attach the support base, along with the carried, enwrapped item, to a separate supporting structure, such as a waistband, belt or other, suitably-shaped, receiving structures. Additionally, by securing an attachment device that is cooperative with the support base attachment mechanism to another support surface, whether on a permanent or temporary basis, the attachment mechanism may be attached to support surfaces that would not otherwise be suitable. Green discloses what appears to be a generic holder securable to another part by means of straps. However, the holder is not configured to be adapted to a curved deck of a kayak and no considerations are given to resolve the bunching problems of securing straps.

Various devices or accessories have been attempted to facilitate the stowage of small items on a kayak for convenient and easy reach of its user. For instance, coolers have been adapted to kayaks or canoes, paddles, fishing rods, bags, etc., have been secured using cockpit-mounted equipment trays which must be mounted by means of clamps, fasteners, e.g., screws, etc., and channeled blocks configured to be secured between cords that crisscross within a deck rigging area. Further, some prior art holders have standoffs or legs that maintain a distance between the holders and the decks over which the holder is disposed such that the bottom of the holder clears the deck and the bottom portion of the holder need not conform to the contour of the deck. However, these devices are often substantial, significantly raising the center of gravity of kayaks and altering the kayaks' dynamics due to wind resistance, etc. and require some modifications to the kayaks or paddleboards to which they are secured. Modifications to a kayak are often frowned upon as they can devalue the kayak, especially high end kayaks, e.g., those constructed from cedar strips and carbon fiber materials. Further, kayaks constructed from frames covered with skins and kayaks made of inflatables require mounting pads to be first installed, e.g., by using adhesives, before other equipment can be removably secured to the kayaks.

There exists a need for a holder useful for holding equipment, e.g., cameras, capable of being mounted at preferable locations to yield desired views, a holder which can be secured to a curved deck surface and a holder that is securable to a kayak without requiring any modifications, e.g., drilling of holes, etc., to the decks of a kayak.

SUMMARY OF THE INVENTION

In accordance with the present invention, there is provided a holder for supporting at least one equipment, the holder configured to be secured to a top surface of a watercraft without requiring modifications to the watercraft, the holder including:

(a) a plate including at least two anchors;

(b) at least two ties, each connecting one of the at least two anchors to a portion of the watercraft, securing the plate to the watercraft; and (c) at least one receptacle disposed on the plate, the receptacle configured for receiving the at least one equipment.

In one embodiment, at least one of the two anchors is a rotary disk anchor. In one embodiment, the holder further includes a pad disposed on a bottom surface of the plate to isolate the plate from the watercraft, wherein contact between the at least one equipment and the watercraft through the at least one receptacle and the bottom surface is avoided by the pad.

In accordance with the present invention, there is further provided a holder for supporting at least one equipment, the holder configured to be secured to a top surface of a watercraft without requiring modifications to the watercraft, the holder including:

(a) a pair of sub plates, each including a front edge, a rear edge, two sides and a bottom surface, the two sides connecting the front edge and the rear edge, wherein the pair of sub plates are configured to be connected in a connection on one of their sides to form a plate disposed at a concave angle;

(b) at least three anchors each disposed on one of at least three corners;

(c) at least three ties each connecting each the anchor to the watercraft;

(d) at least one receptacle disposed on the plate, the receptacle configured for receiving the at least one equipment; and (e) a pad disposed on a bottom surface to isolate the plate from the watercraft, wherein contact between the at least one equipment and the watercraft through the at least one receptacle and the bottom surface is avoided by the pad.

A tie can include a clamp, a pivotable clamp or a retainer. In one embodiment, the connection is a fixed connection. In one embodiment, the connection is a flexible connection. The pad can be constructed from cork, closed cell foam, rubber or any combinations thereof. In one embodiment, the concave angle is about 75 degrees to about 165 degrees. The anchor can be a slot, a pair of slots or a receptacle. In one embodiment, a combined thickness of the plate and the pad is no more than about 2 inch. In one embodiment, the at least one receptacle is a receptacle selected from the group consisting of a threaded hole, a slide and a slot.

An object of the present invention is to provide a personal watercraft equipment holder that is adaptable to a watercraft without requiring modifications to the watercraft.

Another object of the present invention is to provide a personal watercraft equipment holder that does not significantly impact the weight of the personal watercraft, does not significantly alter the overall size of the personal watercraft and the profile of the personal watercraft.

Another object of the present invention is to provide a personal watercraft equipment holder that is low profile.

Whereas there may be many embodiments of the present invention, each embodiment may meet one or more of the foregoing recited objects in any combination. It is not intended that each embodiment will necessarily meet each objective. Thus, having broadly outlined the more important features of the present invention in order that the detailed description thereof may be better understood, and that the present contribution to the art may be better appreciated, there are, of course, additional features of the present invention that will be described herein and will form a part of the subject matter of this specification.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

PARTS LIST

2—holder
4—sub plate
6—anchor, e.g., slot, slots, rotary disk
8—receptacle
10—equipment, e.g., camera
12—watercraft, e.g., kayak
14—deck rigging
16—cockpit of watercraft
18—pad
20—plateau
22—receptacle
24—prior art holder or container
26—deck surface
28—connector
30—watercraft, e.g., paddleboard
32—oar or paddle
34—oar bracket or paddle bracket
36—angle
38—combined thickness of sub plate and pad
40—tie
42—upper piece
44—lower piece
46—slot
48—adjustment clasp
50—clamp
52—protrusion
54—opening
56—radius of space encompassed by clamp
58—angle
60—slot
62—ring
64—angle between strap and rope
66—central axis of rotary disk
68—pivoting mechanism of a pivotable clamp
70—hole
72—anchor stake
74—first crossbar
76—second crossbar
78—third crossbar
80—free end of tie
82—deck line clip retainer
84—half of deck line clip retainer
86—prong
88—hole
90—shell
92—fastener
94—buckle
96—opening
98—first end of buckle
100—second end of buckle

Particular Advantages of the Invention

In one embodiment, the present holder includes two concaved flat surfaces, allowing the present holder to conform to a wider range of curvatures of the kayak decks of different makes and models.

At least one ¼"-20 (20 threads per inch, pitch of 1.270 mm) screw hole is provided to receive a commonly available fastener of an equipment to secure the equipment to the present holder. The present simple and uncomplicated way to hold equipment may not have been possible without a screw hole with this specification.

DETAILED DESCRIPTION OF A PREFERRED EMBODIMENT

The term "about" is used herein to mean approximately, roughly, around, or in the region of. When the term "about" is used in conjunction with a numerical range, it modifies that range by extending the boundaries above and below the numerical values set forth. In general, the term "about" is used herein to modify a numerical value above and below the stated value by a variance of 20 percent up or down (higher or lower).

Figure 1:
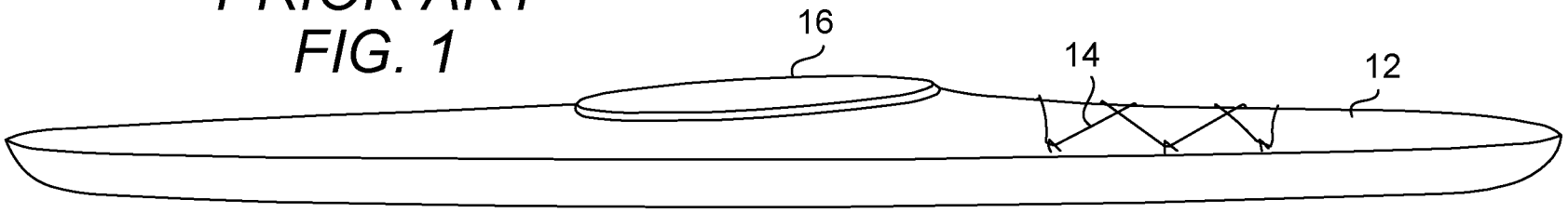
PRIOR ART FIG. 1
FIG. 1 is a side view of a watercraft, depicting the deck rigging of the watercraft.

FIG. 1 is a side view of a watercraft, e.g., kayak, depicting the deck rigging 14 of the kayak. The use of the present holder need not be limited to kayaks, however. Any mildly-curved surfaces, e.g., with curves defined by radii larger than about 1 ft., having a rigging, e.g., with cords, strings, etc., disposed on the surfaces, may serve as support surfaces to the holder.

Figure 2:
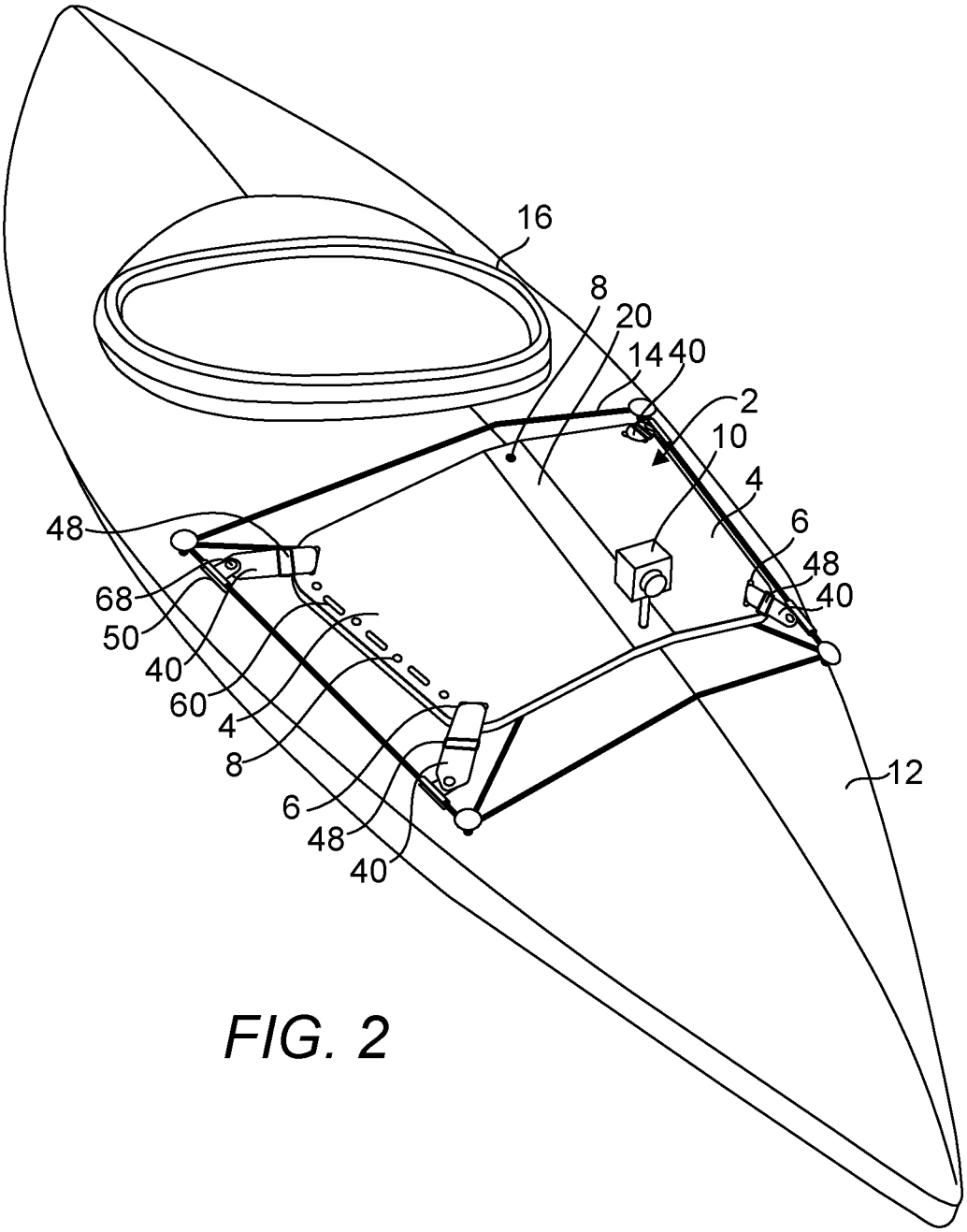
FIG. 2 is a top front perspective view of a present holder being used for holding an equipment while the present holder is secured to a watercraft.
Figure 3:
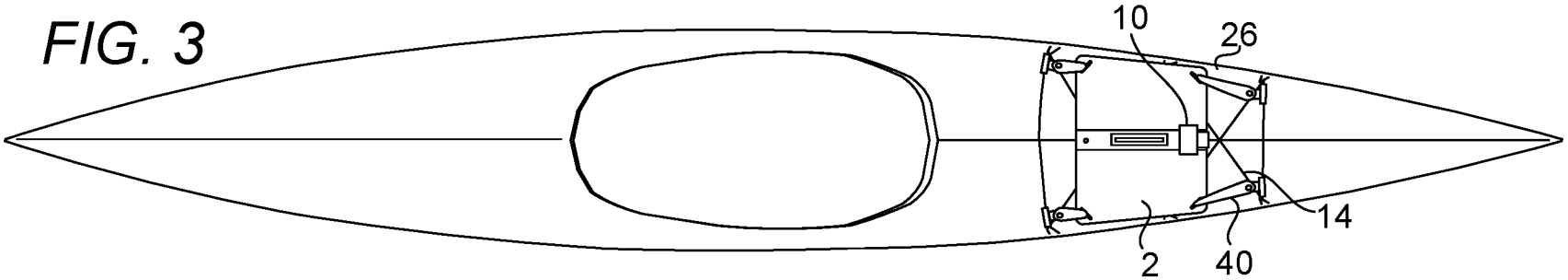
FIG. 3 is a top view of a present holder being used for holding an equipment while the present holder is secured to a watercraft.

FIG. 2 is a top front perspective view of a present holder being used for holding an equipment while the present holder 2 is secured to a watercraft, e.g., kayak. FIG. 3 is a top view of a present holder being used for holding an equipment while the present holder is secured to a watercraft. The holder shown herein is a trapezoidally-shaped plate bent medially to form a plateau 20 flanked by sub plates 4, forming two portions disposed at a concave angle 58 that conforms to a curved kayak 12 deck. The sub plates 4 and plateau 20 serve as a base for holding cameras, e.g., action cameras and suitable mounting and water-proofing accessories, fishing rod holders, paddle holders, beverage can or bottle holders and mounting tracks, etc., negating the need for surfaces of the kayak to be permanently modified or scarred. The holder 2 is configured to be secured to a top surface of a kayak without requiring modifications to the watercraft. Deck riggings are commonly provided on the forward and rearward decks of a kayak. The forward deck is the deck in front of the cockpit 16 while the rearward deck is the deck in the rear of the cockpit 16. Deck riggings can include crisscrossed elastic bungee cords that serve as hand grips and surface features to which bags or other materials are secured to a kayak. In the embodiment shown in FIG. 2, the holder includes a pair of sub plates 4, each including a front edge, a rear edge, two sides and a bottom surface, the two sides connecting the front edge and the rear edge to form four corners. The front edge is configured shorter than the rear edge to make the platform shape conform better to the shape of the forward deck. Likewise, if a rearward deck holder is desired, the front edge of the holder will be wider than the rear edge of the holder. In one embodiment, the plate is formed by bending a flat piece into concaved sub plates 4 and a plateau 20 disposed between the sub plates 4. It is also possible to form the plate by joining sub plates 4 with a central piece to form the plateau 20. Receptacles, e.g., threaded holes 8, slides 22 or tracks, through holes, studs and slots may be disposed on the surfaces of the holder 2 for receiving various equipment 10, e.g., cameras, oars or paddles 32 and fishing rod holders, etc. Threaded holes are useful for receiving screws securing cameras, track mounts and other equipment. No modifications, e.g., drilling of mounting holes and tapping of these holes, etc., are required to be made to a kayak to allow the plate to be mounted. Any potential loss of integrity, beauty or value, etc., due to such modifications can therefore be avoided. A pad 18 is attached to at least a portion of the bottom surfaces of holder 2 to isolate the plate from the watercraft while the holder is in use to avoid contact between equipment and fasteners used for securing the equipment to the holder. The pad is constructed from cork, closed-cell foam, rubber or another material capable of stabilizing the holder atop a kayak deck while not having a surface having a hardness capable of marring the kayak deck surface. The pad useful for protecting a deck surface upon which the plate is disposed while allowing the plate to be more securely seated atop the deck as the pad is capable of conforming even better to the deck surface 26, increases the contact surface area to help immobilize the plate and the equipment mounted thereupon with respect to the kayak. In one embodiment, the plate is constructed from plastic, natural wood or resin-infused fiber.

Figure 4:
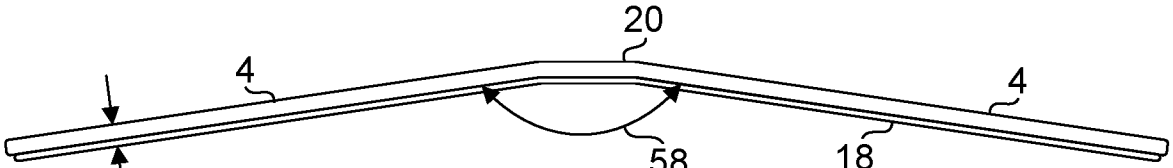
FIG. 4 is a front view of a present holder.
Figure 5:
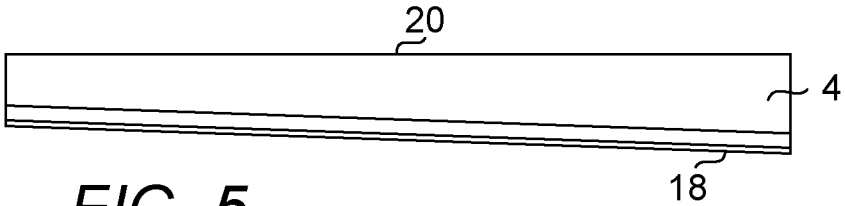
FIG. 5 is a side view thereof.
Figure 6:
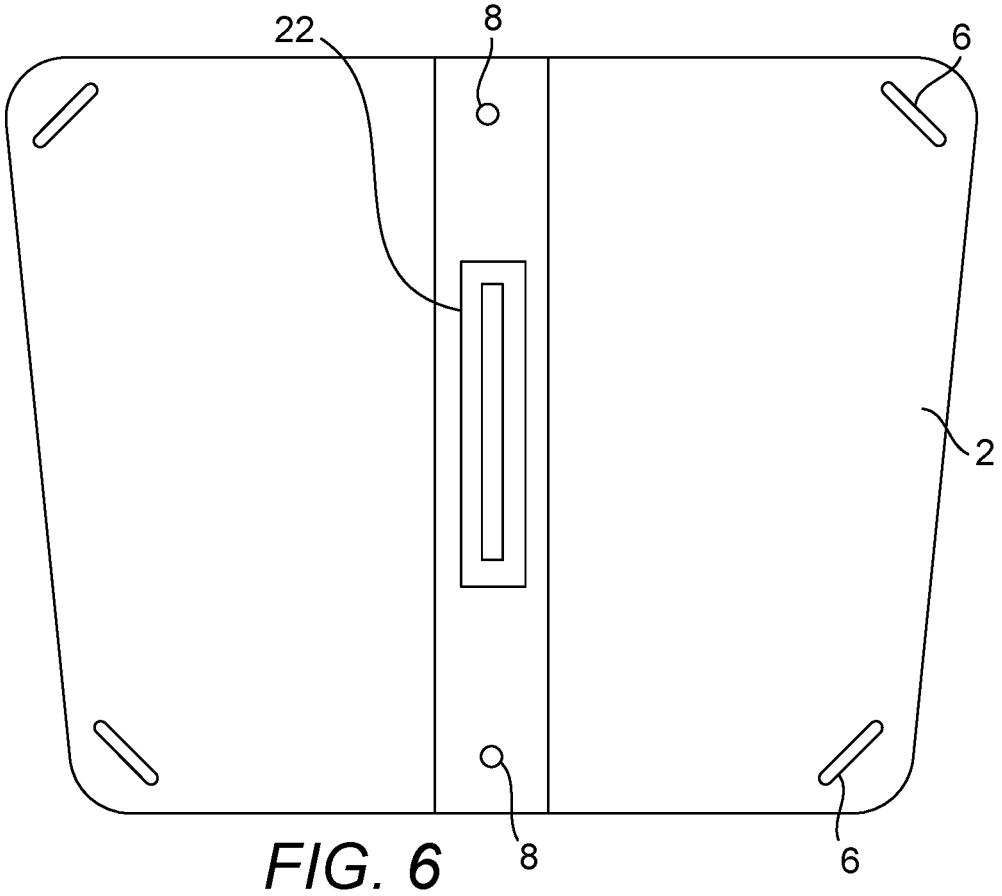
FIG. 6 is a top view of a present holder.

In one embodiment, a tie 40 is provided at each corner of the plate to secure the corner to the rigging 14. In this embodiment, each tie 40 is a strap looped through an anchor, e.g., a slot 6, at one end and the strap is terminated at the opposing end with a pivotable clamp 50, i.e., a clamp that is hinged with respect to the tie it terminates, with a pivoting mechanism 68. It is also possible to use a fixed clamp although if the clamp is non-pivotable, bunching in the tie or strap is more prone to occur and the clamping force applied to the rigging has a higher tendency to be dislodged due to the application of tension in the tie that is not disposed in a straight line. In the embodiment shown in FIG. 2, the connection is a fixed connection as the sub plates 4 are integrally connected or the connection is rigid, rendering the sub plates 4 with or without a plateau 20, a single unit. FIG. 4 is a front view of a present holder 2. FIG. 5 is a side view thereof. FIG. 6 is a top view of a present holder. In this embodiment, the pair of sub plates 4 are configured to be connected in a rigid connection on one of their sides to form a plate disposed at a concave angle 58. Slots 60 are disposed near the periphery of the plate for receiving straps or strap assemblies useful for securing the plate to the deck rigging including crisscrossed elastic bungee cords, on either a forward deck or a rearward deck although only deck rigging on the forward deck is shown in previously disclosed figures. Some slots, especially those disposed at corners of the plate are orientated in a manner to avoid "bunching" of the ties 40, e.g., straps, as a strap is most effectively secured to a cord when the strap is disposed as close to a right angle as possible to a cord. It shall be noted that when corner slots 6 are used as anchors, they are preferably disposed at an angle of about 45 degrees with respect to a front edge or a rear edge of the plate. This way, the straps are less severely impacted as the slots 6 are disposed at most, only at about 45 degrees with respect to the point where the rigging is engaged. When peripheral or edge slots 60 are provided, they may alternatively or additionally be used for securely positioning the holder 2. In one embodiment, the combined thickness 38 of the plate and the pad is no more than about 2 inch. At this low profile, the kayaks' dynamics due to wind resistance is not significantly altered.

Figure 7:
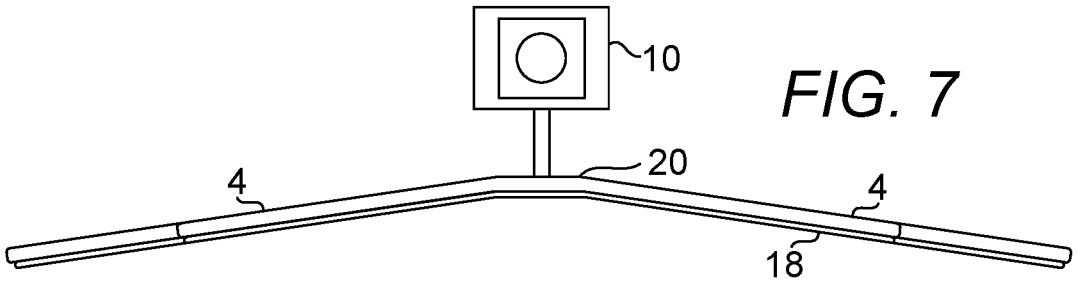
FIG. 7 is a front view of a present holder, depicting an equipment having been mounted on the holder.
Figure 8:
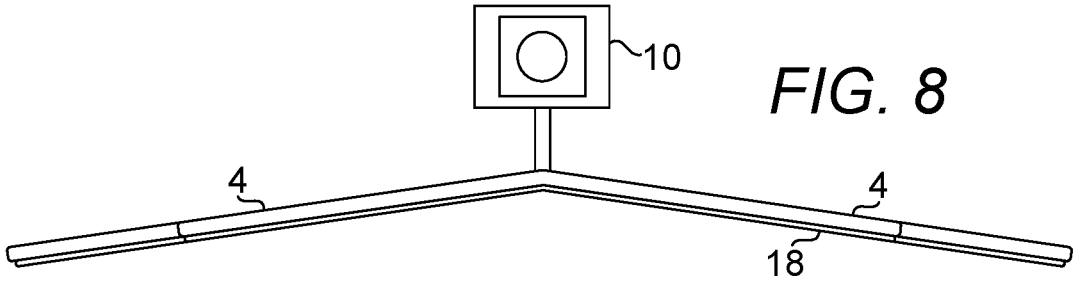
FIG. 8 is a front view of another embodiment of a present holder, depicting an equipment having been mounted on the holder.

FIG. 7 is a front view of a present holder, depicting an equipment, e.g., a camera, having been mounted on the holder. It shall be noted that, due to the low profile of the holder, the only impact to wind resistance or even center of gravity is due to the mass associated with the equipment itself. FIG. 8 is a front view of another embodiment of a present holder, depicting an equipment having been mounted on the holder. Here, it shall be noted that the holder lacks a plateau 20 as compared to the holder shown elsewhere herein.

Figure 9:
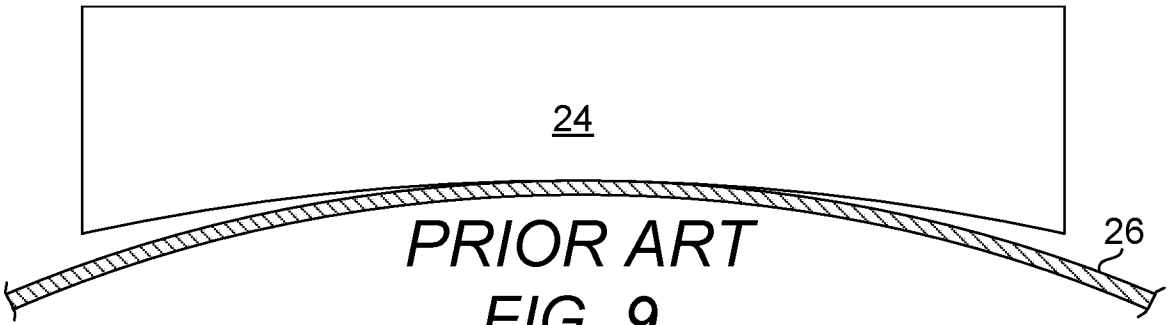
PRIOR ART FIG. 9
FIGS. 9-11 are figures depicting prior art holders or containers having bottom profiles unsuitable to be securely disposed on a curved surface.
Figure 10:
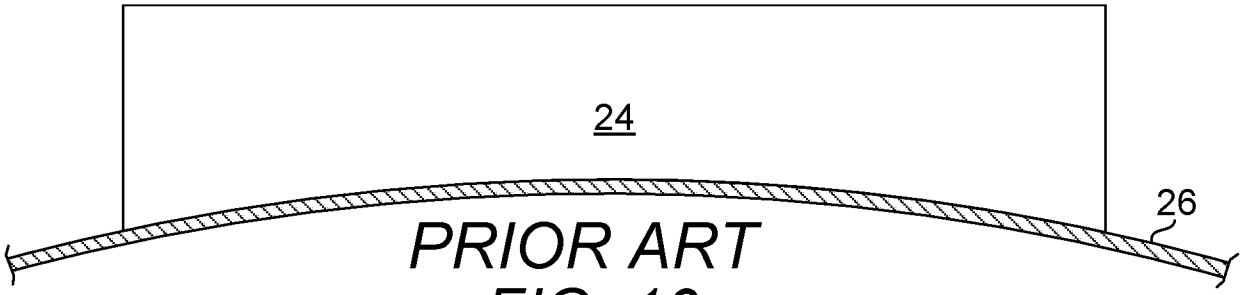
PRIOR ART FIG. 10
Figure 11:
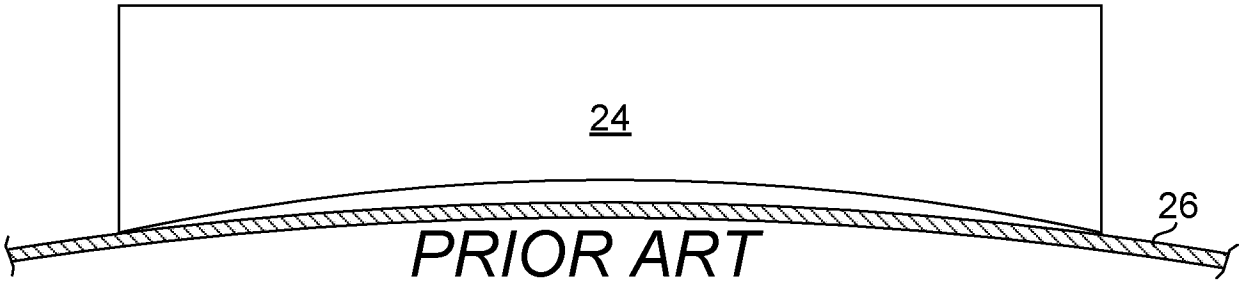
PRIOR ART FIG. 11

FIGS. 9-11 are figures depicting prior art holders or containers having bottom profiles unsuitable to be securely disposed on a curved surface. According to conventional wisdom, the quest to adapt a first part having a curved surface to a second part having a flat surface often involves providing a curved surface to the second part in the hopes that the second part may be adapted better or more closely to the first part. Here, it shall be noted that the only container 24 that conforms well to deck surface 26 is the container 24 shown in FIG. 10 as the two curves, i.e., the bottom curve of the container 24 and the deck surface 26 match precisely. If the radius of the curve is too large, as in the case shown in FIG. 9, the container 24 tends to teeter about the peak of the deck surface. If the radius of the curve is too small, as in the case shown in FIG. 11, the contact areas are minimal, therefore the container 24 is not properly supported. In the watercraft industry, kayaks are made with forward and rearward decks having various curves as standards governing this aspect of the watercraft do not exist. Therefore, the likelihood that attempts to provide a curved surface to a part for the part to be supported on a curved surface will fail, is high.

Figure 12:
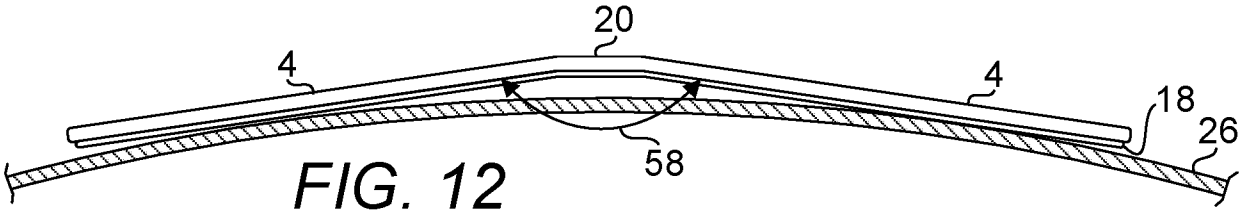
FIGS. 12-14 are figures depicting a present holder suitable to be securely disposed on various curved surfaces.
Figure 13:
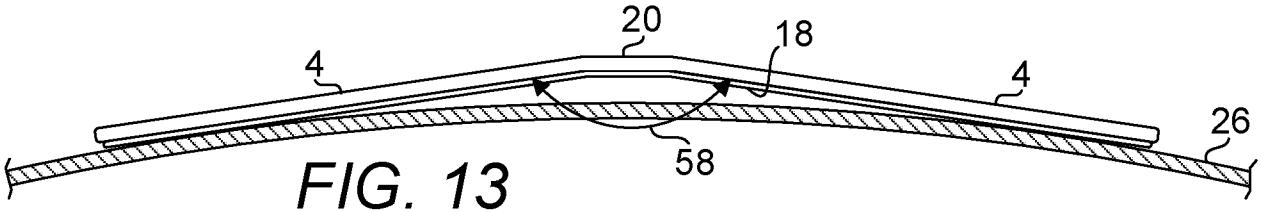
Figure 14:
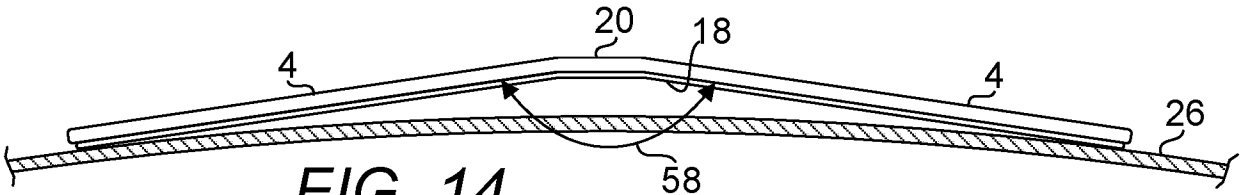

FIGS. 12-14 are figures depicting a present holder suitable to be securely disposed on various curved surfaces. Concave angle 58 of about 75 degrees to about 165 degrees have been found to be suitable for most kayaks. Note that with the present holder, although the deck surface 26 shown in FIGS. 12-14 are curved to various degrees, the present holder is properly supported.

Figure 15:
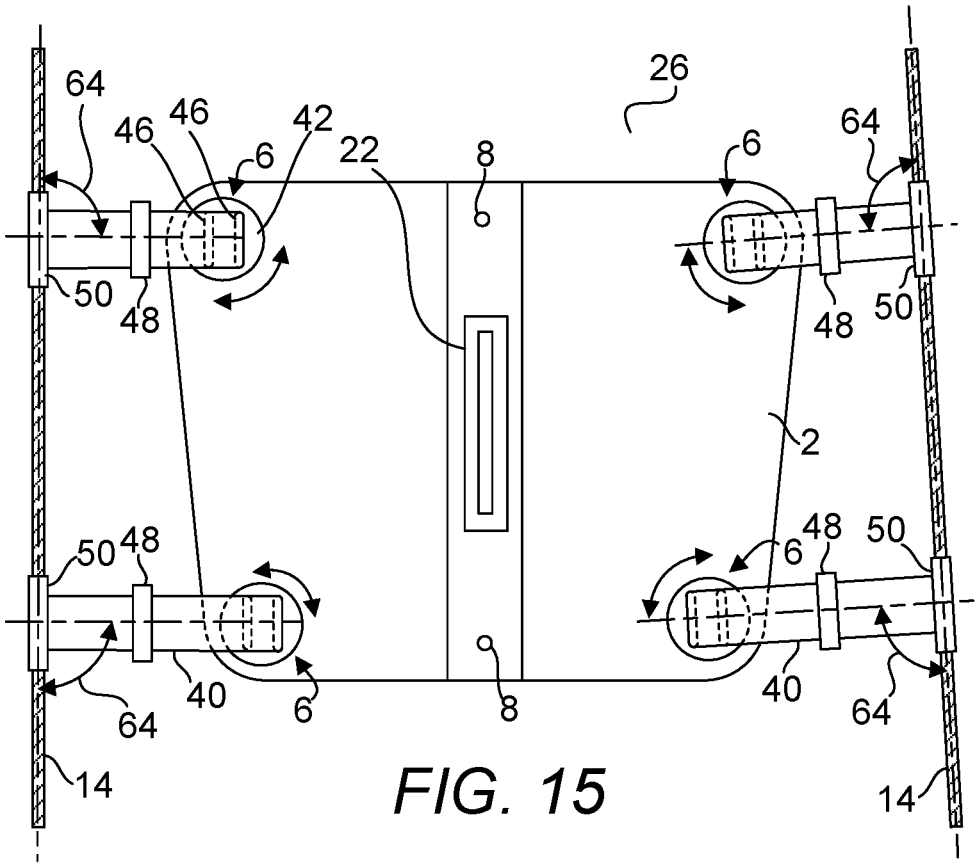
FIG. 15 is a top view of one embodiment of an anchor and tie combination of a present holder, depicting a manner in which such combination is adaptable to a rigging configuration.
Figure 16:
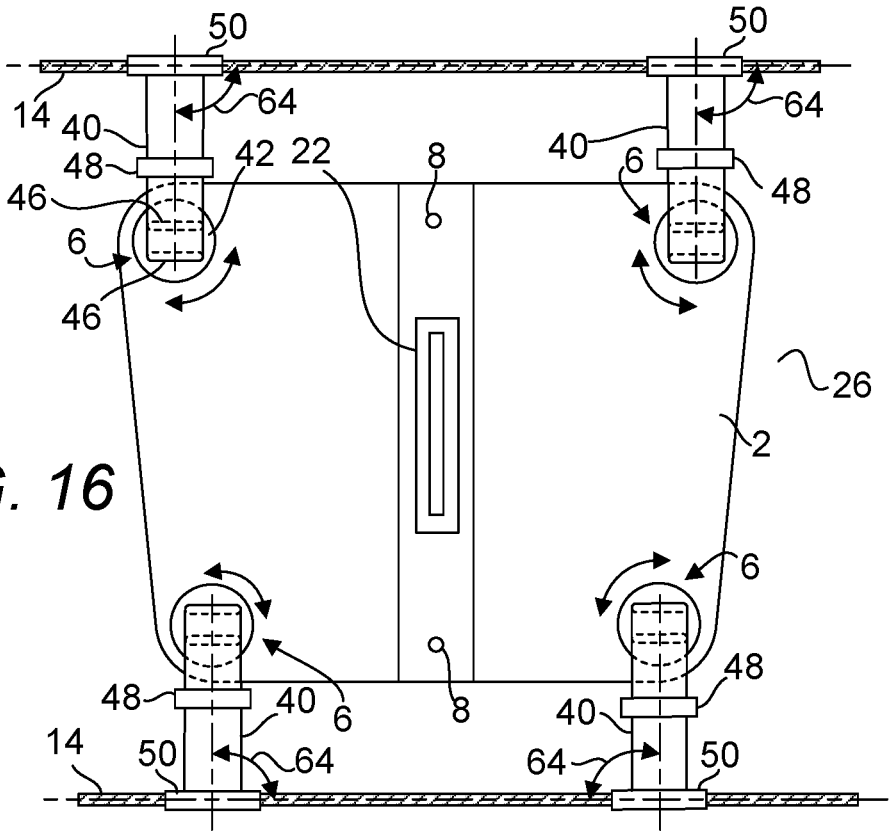
FIG. 16 is a top of one embodiment of an anchor and tie combination of a present holder, depicting another manner in which such combination is adaptable to a rigging configuration.

FIG. 15 is a top of one embodiment of an anchor and tie combination of a present holder, depicting a manner in which such combination is adaptable to a rigging configuration. FIG. 16 is a top of one embodiment of an anchor and tie combination of a present holder, depicting another manner in which such combination is adaptable to a rigging configuration. It shall be noted that, with this combination, each tie or strap is capable to be orientated in directions indicated in FIGS. 15 and 16 such that it is disposed substantially normal (see angle 64) to a rope of the rigging 14 to secure support the holder to the deck surface 26 to minimize slippages of the clamps 50 with respect to the ropes to which they are secured. An adjustment clasp 48 is provided for each tie such that the length adjustment of each tie is possible.

Figure 17:
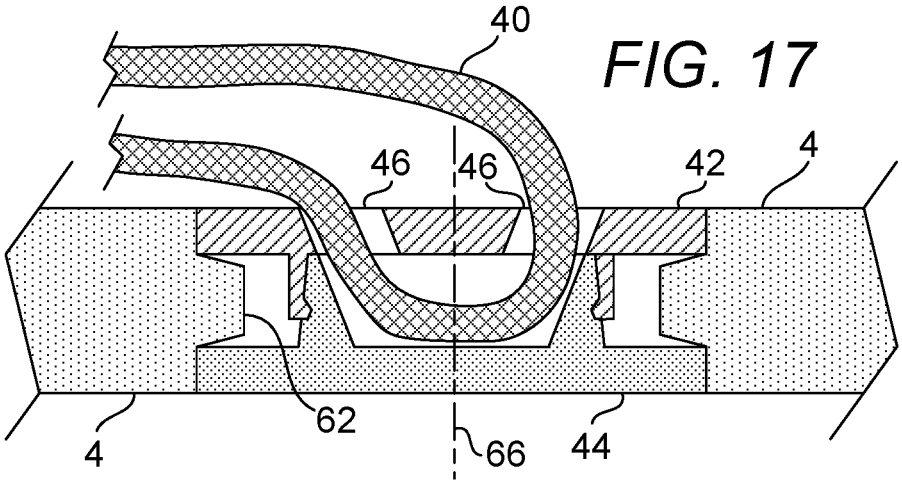
FIG. 17 is a cross-sectional view of a rotary disk anchor, depicting a manner in which a tie is secured to the anchor.

FIG. 17 is a cross-sectional view of a rotary disk anchor, depicting a manner in which a tie is secured to the anchor. An anchor 6, in this embodiment, is essentially a rotary disk including an upper piece 42 that is coupled with a lower piece 44 within an opening disposed at a corner of a sub plate 4 as shown in FIG. 15 or FIG. 16. The opening, which is a through hole is countersunk from both the top and bottom surfaces of the sub plate 4. Upon coupling, the upper piece 42 is prevented from being dislodged from the lower piece 44 by a ring 62. Disposed on the upper piece 42 is a pair of slots 46 which allow a tie 40, e.g., strap to be looped around and protrude from the upper surface of the upper piece 42. In this embodiment, the upper piece 42 may rotate about a central axis 66 of the rotary disk. The rotary disk need not be composed of an upper piece and a lower piece. As long as the disk is capable of rotation about an axis, the disk is useful in allowing rotation of a strap attached to the disk about the axis.

Figure 18:
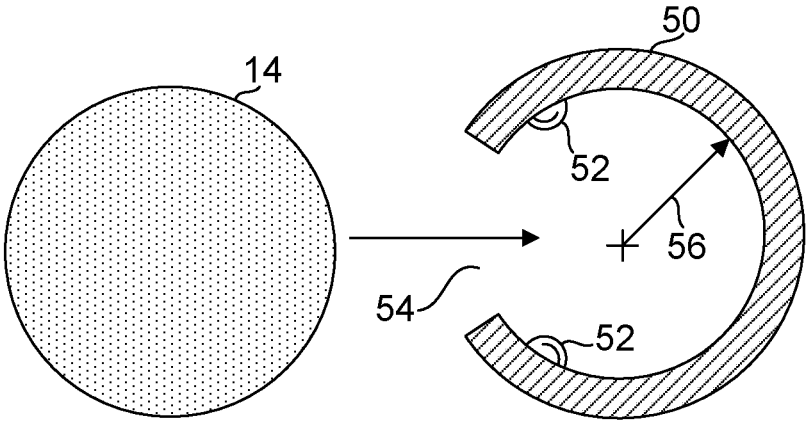
FIG. 18 is a cross-sectional view of a clamp configured to be coupled to a rope or cord of a rigging.

FIG. 18 is a cross-sectional view of a clamp configured to be coupled to a rope of a rigging. In this embodiment, the rope is to be pressed against the opening 54 of the clamp 50 until it is seated by friction, in its entirety, within the space encompassed by the clamp 50. To reduce inadvertent detachment of the rope from the clamp 50, the internal surfaces of the clamp 50 is preferably roughened to increase friction while coupled with a rope and hence the retaining ability of the clamp 50. In one embodiment, protrusions 52 are provided on the internal surfaces of the clamp 50. The radius 56 of space encompassed by the clamp 50 is preferably smaller that the radius of the rope at rest. In securely attaching the clamp 50 to the rope, the rope is preferably tensioned to reduce the radius of the rope before the tensioned or thinned section of the rope is forced into and seated in the space through opening 54.

Figure 19:
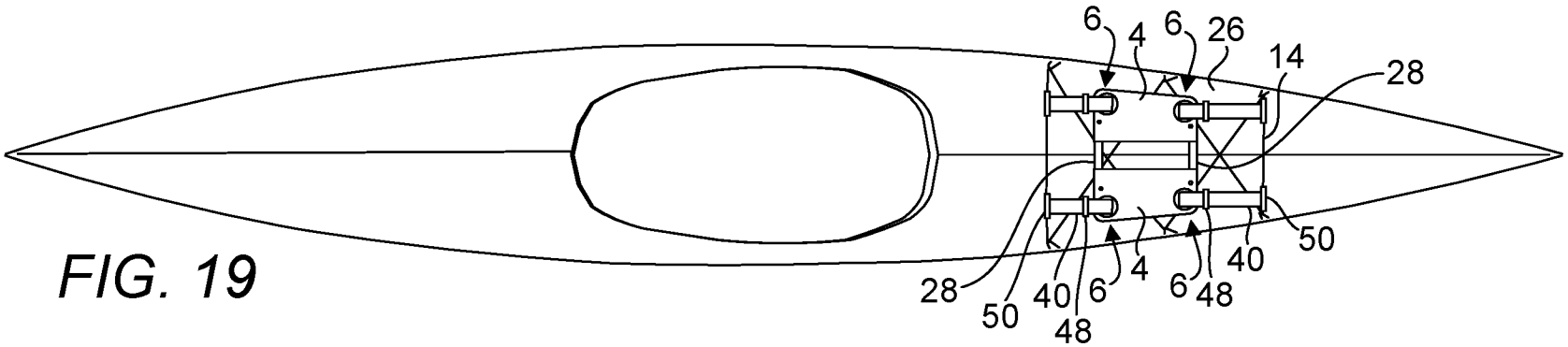
FIG. 19 is a top view of yet another embodiment of a present holder, depicting two sub plates that are connected using a flexible material, allowing the sub plates to conform more readily to the surface of the deck surface upon which the present holder is disposed.
Figure 20:
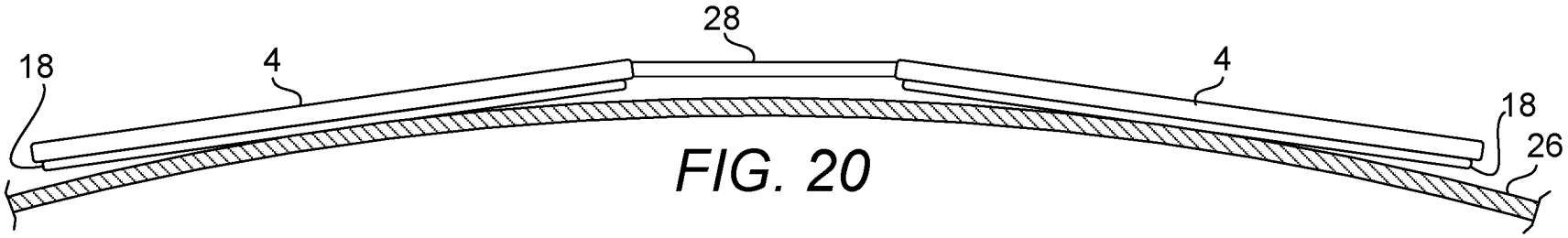
FIG. 20 is a cross-sectional view of the embodiment of the holder shown in FIG. 19, depicting two sub plates that are connected using a flexible material, allowing the sub plates to conform more readily to the surface of the deck surface upon which the present holder is disposed.

FIG. 19 is a top view of yet another embodiment of a present holder, depicting two sub plates 4 that are connected using a connector 28 that is flexible, allowing the sub plates 4 to conform more readily to the surface of the deck surface upon which the present holder is disposed as shown in FIG. 20. FIG. 20 is a cross-sectional view of the embodiment of the holder shown in FIG. 19, depicting two sub plates 4 that are connected using a flexible material, allowing the sub plates 4 to conform more readily to the deck surface upon which the present holder is disposed.

Figure 21:
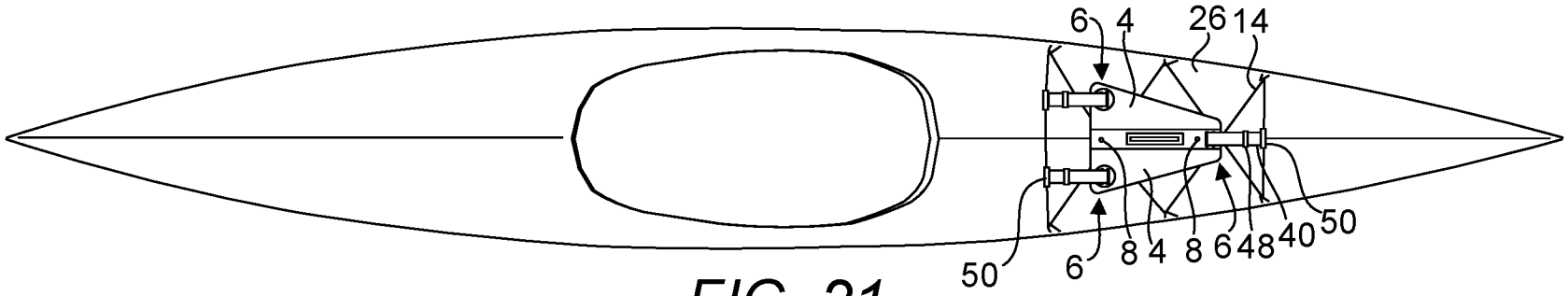
FIG. 21 is a top view of another embodiment of a present holder, depicting only three anchors useful for securing the present holder.

FIG. 21 is a top view of another embodiment of a present holder, depicting only three anchors useful for securing the present holder and a triangularly-shaped plate. Here, the front edge of holder is shorter as compared to holders disclosed elsewhere herein. As the holder takes on the shape of a triangle, it fits more suitably with the tip or front or rear end of a kayak. Only one anchor is provided for the front tip of the holder.

Figure 22:
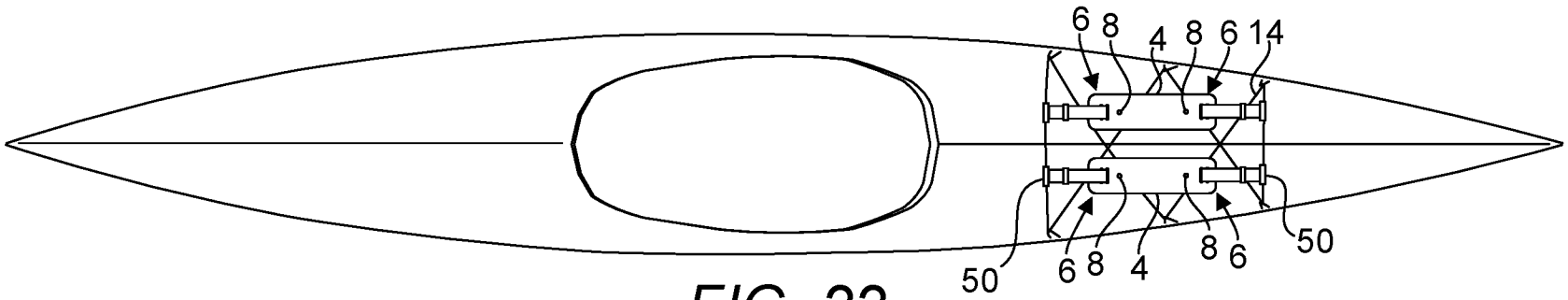
FIG. 22 is a top view of yet another embodiment of a present holder, depicting only two anchors useful for securing the present holder.

FIG. 22 is a top view of yet another embodiment of a present holder, depicting only two anchors useful for securing the present holder. Here, the opposingly-disposed clamps 50 are useful for being secured to the ropes disposed on the front and rear edges of the rigging 14.

Figure 23:
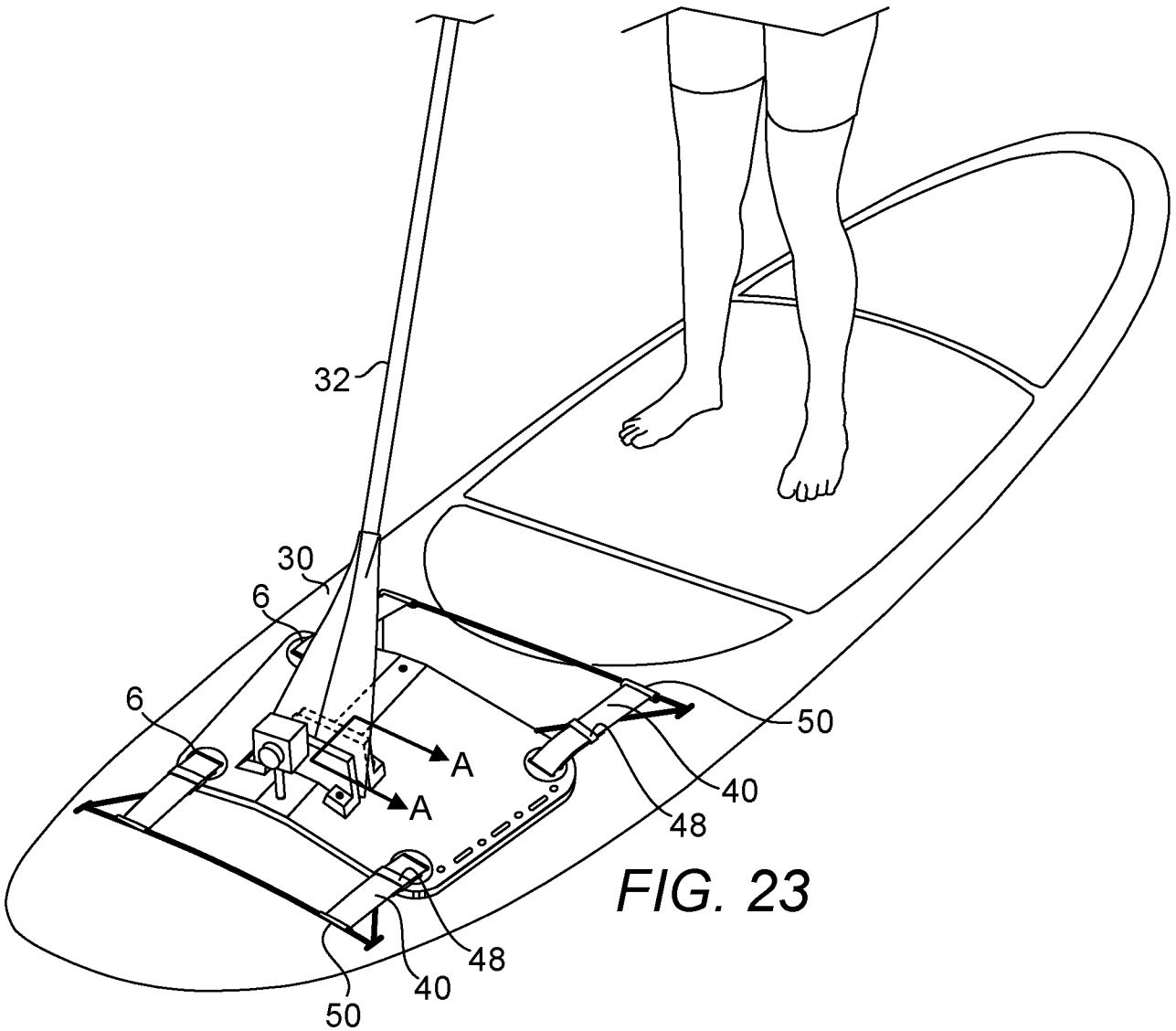
FIG. 23 is a top perspective view depicting a manner in which an oar or paddle can be secured using a present holder.
Figure 24:
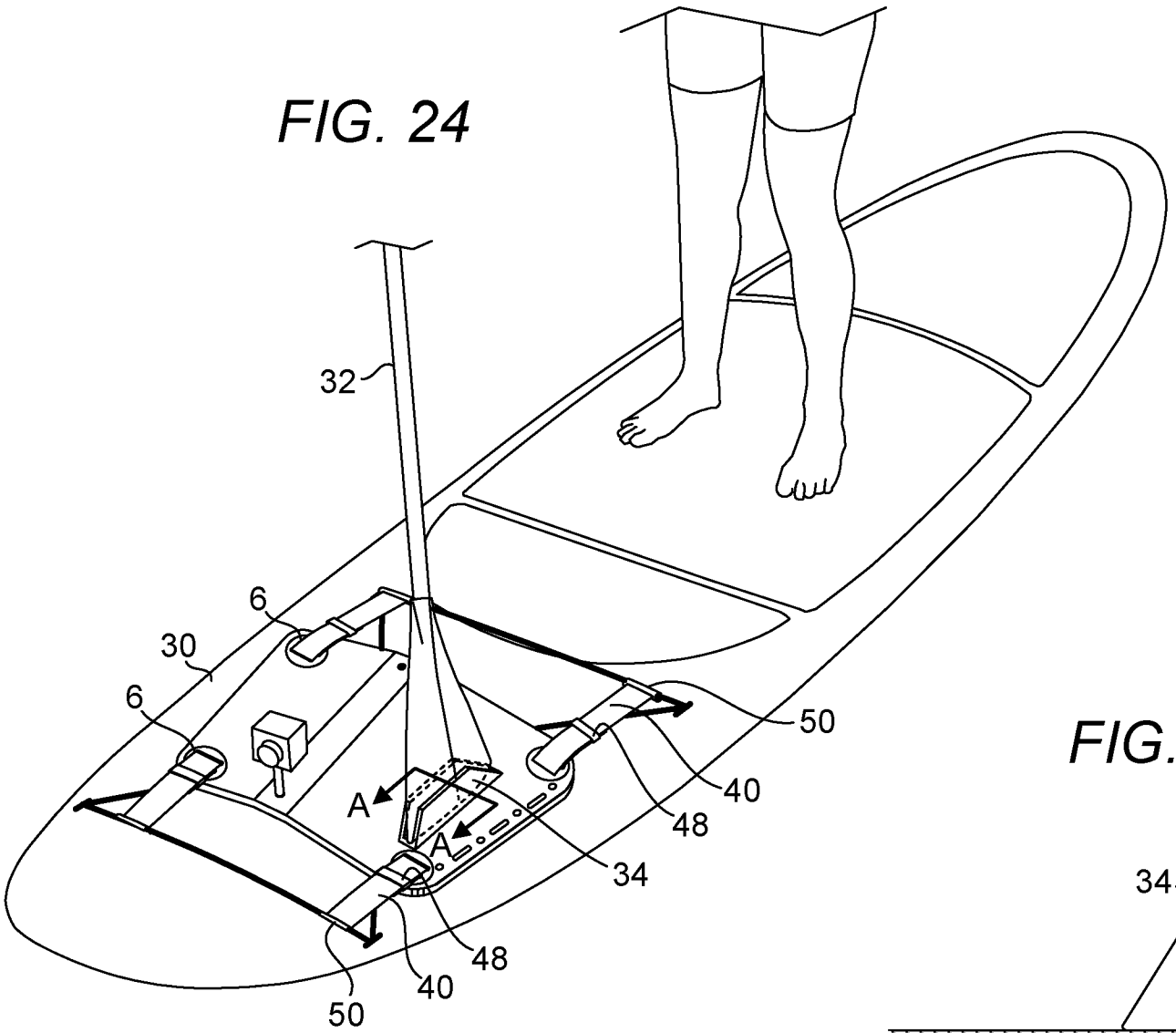
FIG. 24 is a top perspective view depicting another manner in which an oar or paddle can be secured using a present holder.
Figure 25:
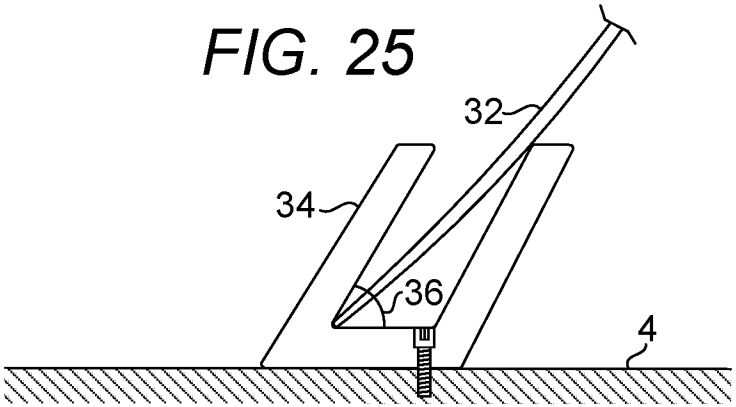
FIG. 25 is a cross-sectional view of an oar bracket as taken along line A-A of FIG. 23 or FIG. 24.

FIG. 23 is a top perspective view depicting a manner in which an oar or paddle 32 can be secured using a present holder. FIG. 24 is a top perspective view depicting another manner in which an oar or paddle 32 can be secured using a present holder. The watercraft disclosed in these two figures is a paddleboard 30 and the equipment held in the holder is an oar or paddle 32. Here, an oar or paddle bracket 34 is shown disposed on two different locations in FIGS. 23 and 24. In FIG. 23, the oar or paddle bracket 34 is shown disposed with its opening aligned with the lengthwise direction of the paddleboard 30 while in FIG. 24, the oar bracket 34 is shown disposed centrally with its opening normal to the lengthwise direction of the paddleboard 30. Again, no modifications are required to be made to the paddleboards. FIG. 25 is a cross-sectional view of an oar or paddle bracket 34 as taken along line A-A of FIG. 23 or FIG. 24. The bracket 34 is essentially a pair of slanted side walls disposed at an angle 36 of from a right angle to about 30 degrees where the slanted walls extend from a base. In securing the bracket 34 to the paddleboard 30, the base is simply fastened to one or more receptacles of the holder via, e.g., one or more fasteners.

Figure 26:
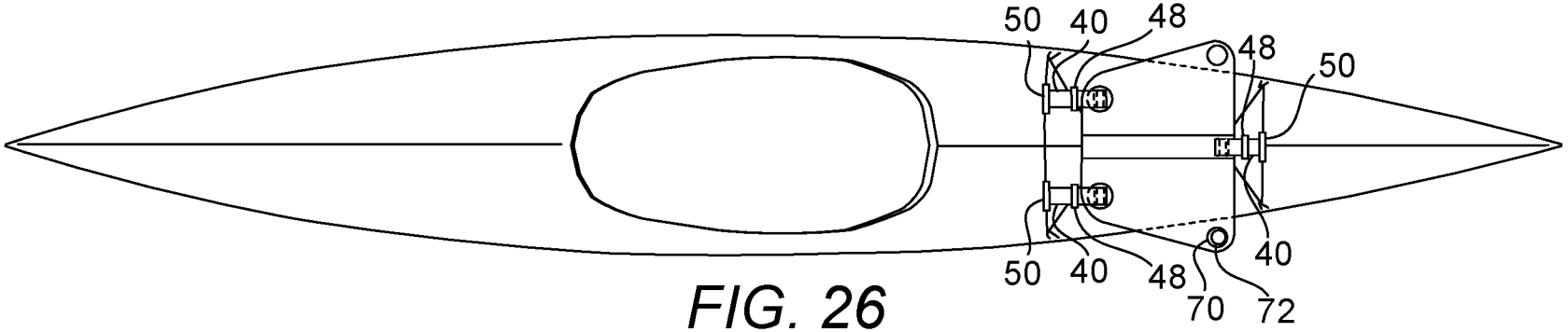
FIG. 26 is a top view of yet another embodiment of a present holder, depicting two holes, each being useful for securing the kayak to a shallow water anchor stake.

FIG. 26 is a top view of yet another embodiment of a present holder, depicting two holes, each being useful for securing the kayak to a shallow water anchor stake 68. Here, the longer edge of the trapezoidally-shaped holder is disposed closer to the tip of a kayak. Each anchor near this edge is vacated, leaving only a hole 70 through which an anchor stake 72 can be disposed to be secured to the underwater floor of shallow water, keeping the kayak in place.

Figure 27:
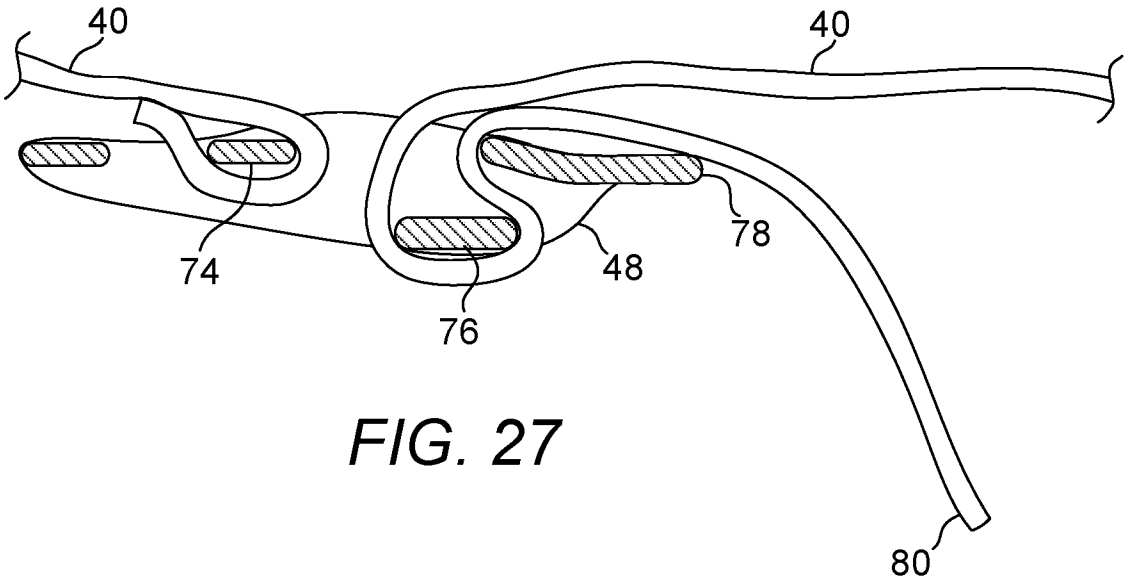
FIG. 27 is a partial cross-sectional side orthogonal view of one embodiment of an adjustment clasp interposed within a tie to enable adjustments of the tie.

FIG. 27 is a partial cross-sectional side orthogonal view of one embodiment of an adjustment clasp 48 interposed within a tie 40 to enable adjustments of the tie. The adjustment clasp 48 is configured to allow length adjustment of the tie 40. In this embodiment, the adjustment clasp 48 comprises a first crossbar 74, a second crossbar 76 and a third crossbar 78, where the first crossbar 74 is rotatably connected to a portion of tie 40, the second and third crossbars 76, 78 are adjustably connected to the tie 40 with a free end 80 of the tie 40 accessible to hand grasp. The second and third crossbars 76, 78 are essentially two substantially staggered plates where the free end 80 of the tie 40 is routed around the third crossbar 76, through the cavity between the second and third crossbars 76, 78 and out around the third crossbar 78 in a direction away from the adjustment clasp 48. In use, the free end 80 of the tie 40 is pulled such that appropriate tension results in the tie 40.

Figure 28:
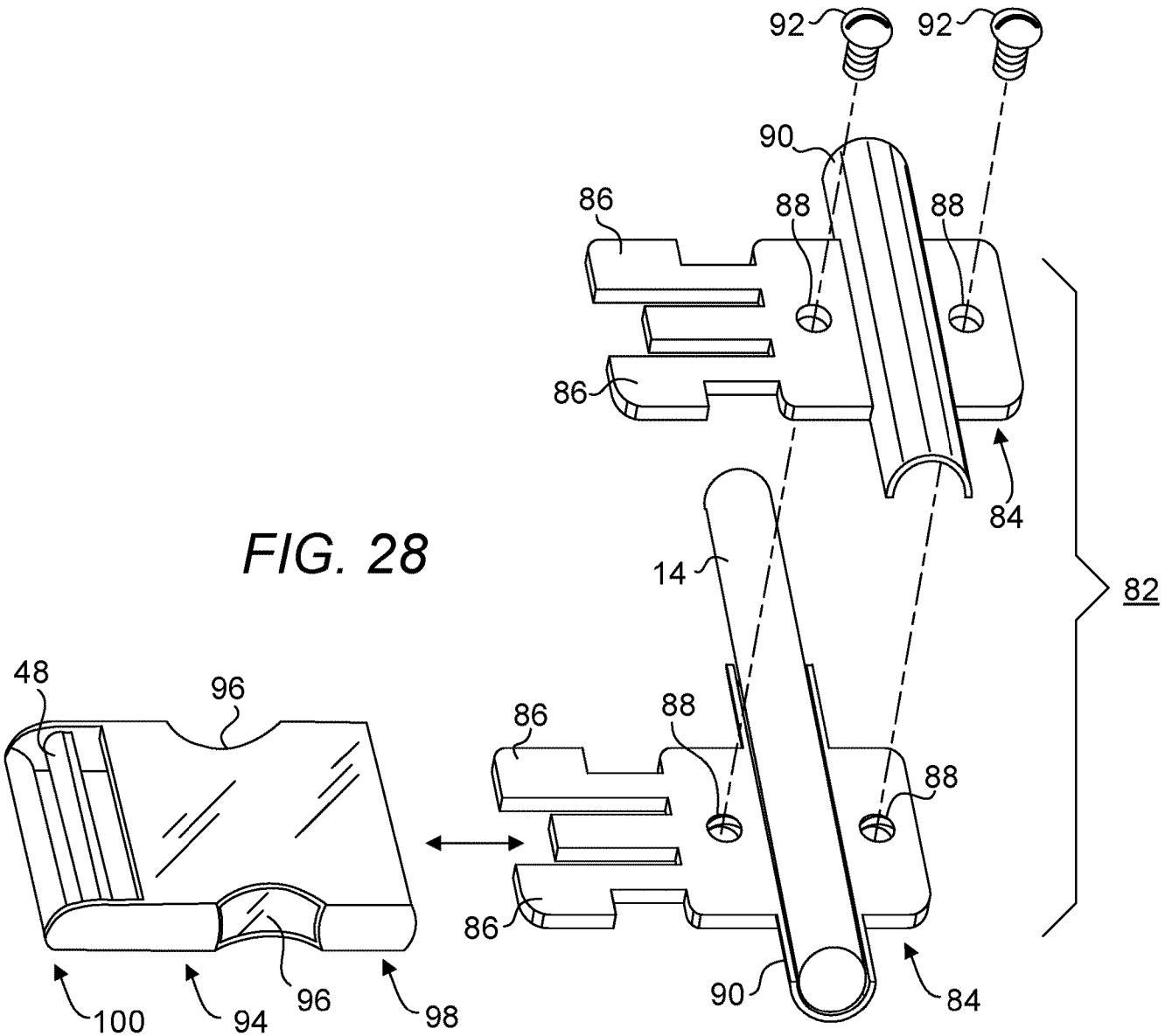
FIG. 28 is a diagram depicting a mechanism configured for securing a strap to a deck rigging.

FIG. 28 is a diagram depicting a mechanism 82 configured for securing a tie 40, e.g., strap to a deck rigging 14 or cord. Here, the mechanism 82 is a retainer capable to be positively but removably secured a deck rigging 14 or a cord. The retainer 82 includes two halves 84 each including a buckle-engaging end and a cord-engaging end. The buckle-engaging end is configured to be removably secured to a buckle 94 and the cord-engaging end is configured to be removably secured to a cord or rope of the deck rigging. Upon installation of the retainer 82 on a cord 14, the retainer 82 is said to be positively secured to the cord 14 as a tug on the retainer 82 due to normal use causes a pull on the cord 14 but the cord 14 cannot become detached from the retainer 82 although the cord 14 may slide with respect to the retainer 82. The buckle-engaging end includes a pair of prongs 86 each removably coupled to an edge of an opening 96 of the buckle 94. To engage a retainer 82 to a cord 14, a half 84 is first disposed on one side of the cord 14 such that the cord 14 is cradled within a shell 90 of the half 84. The other half 84 is then disposed with its shell 90 arranged to be clamped against the first half 84 to secure the cord 14 within a cavity between the two shells 90. Fasteners 92, e.g., screws, can now be used to secure the two halves 84 via holes 88. Once the halves 84 have been secured against one another, the retainer 82 can then be pushed, with its pronged end facing the buckle 94, against a first end 98 of the buckle 94, through a cavity such that the prongs 86 are subsequently seated in the openings 96. The prongs 86 can be constructed from a resilient material, e.g., plastic or spring steel, such that a squeeze on the prongs 86 deforms the prongs 86 to allow them to be slid into the cavity of the buckle 94 or to be removed from the buckle 94 through the same cavity. In this embodiment, the second end 100 of the buckle 94 includes a built-in adjustment clasp 48 to facilitate the adjustment of a strap secured to this end 100 of the buckle.

The detailed description refers to the accompanying drawings that show, by way of illustration, specific aspects and embodiments in which the present disclosed embodiments may be practiced. These embodiments are described in sufficient detail to enable those skilled in the art to practice aspects of the present invention. Other embodiments may be utilized, and changes may be made without departing from the scope of the disclosed embodiments. The various embodiments can be combined with one or more other embodiments to form new embodiments. The detailed description is, therefore, not to be taken in a limiting sense, and the scope of the present invention is defined only by the appended claims, with the full scope of equivalents to which they may be entitled. It will be appreciated by those of ordinary skill in the art that any arrangement that is calculated to achieve the same purpose may be substituted for the specific embodiments shown. This application is intended to cover any adaptations or variations of embodiments of the present invention. It is to be understood that the above description is intended to be illustrative, and not restrictive, and that the phraseology or terminology employed herein is for the purpose of description and not of limitation. Combinations of the above embodiments and other embodiments will be apparent to those of skill in the art upon studying the above description. The scope of the present disclosed embodiments includes any other applications in which embodiments of the above structures and fabrication methods are used. The scope of the embodiments should be determined with reference to the appended claims, along with the full scope of equivalents to which such claims are entitled.

What is claimed herein is:

1. A holder for supporting at least one equipment, said holder configured to be secured to a top surface of a watercraft without requiring modifications to the watercraft, said holder comprising: (a) a pair of sub plates, each comprising a front edge, a rear edge, two sides and a bottom surface, said two sides connecting said front edge and said rear edge, wherein said pair of sub plates are configured to be connected in a connection on one of their sides to form a plate disposed at a concave angle and at least three corners; (b) at least three anchors each disposed on one of said at least three corners; (c) at least three ties each connecting each said anchor to the watercraft; said ties being adjustable in length so as to allow holders of difference sizes to be accommodated;

(d) at least one receptacle disposed on said plate, said at least one receptacle configured for receiving the at least one equipment; and (e) a pad disposed on said bottom surface to isolate said plate from the watercraft, wherein contact between the at least one equipment and the watercraft through said at least one receptacle and said bottom surface is avoided by said pad.

2. The holder of claim 1, wherein at least one of said three anchors is a rotary disk anchor.

3. The holder of claim 1, wherein at least one of said three anchors comprises an anchor selected from the group consisting a slot and a pair of slots.

4. The holder of claim 1, wherein at least one of said three ties comprises a device selected from the group consisting of a clamp, a pivotable clamp and a retainer.

5. The holder of claim 1, wherein said connection is a fixed connection.

6. The holder of claim 1, wherein said connection is a flexible connection.

7. The holder of claim 1, wherein said pad is a material selected from the group consisting of cork, closed-cell foam, rubber and any combinations thereof.

8. The holder of claim 1, said concave angle is an angle selected of about 75 degrees to about 165 degrees.

9. The holder of claim 1, wherein a combined thickness of said plate and said pad is no more than about 2 inch.

10. The holder of claim 1, wherein said at least one receptacle is a receptacle selected from the group consisting of a threaded hole, a slide, a track and a through hole.

11. The holder of claim 1, further comprising a slanted bracket configured to be secured to said holder by way of said at least one receptacle.

12. A holder for supporting at least one equipment, said holder configured to be secured to a top surface of a watercraft without requiring modifications to the watercraft, said holder comprising: (a) a plate comprising at least two anchors; (b) at least two ties, each connecting one of said at least two anchors to a portion of the watercraft, securing said plate to the watercraft; and said ties being adjustable in length so as to allow holders of difference sizes to be accommodated and (c) at least one receptacle disposed on said plate, said receptacle configured for receiving the at least one equipment.

13. The holder of claim 12, wherein at least one of said at least two anchors is a rotary disk anchor.

14. The holder of claim 12, further comprising a pad disposed on a bottom surface of said pad to isolate said plate from the watercraft, wherein contact between the at least one equipment and the watercraft through said at least one receptacle and said bottom surface is avoided by said pad.

15. The holder of claim 12, wherein said plate comprises two sub plates disposed at a concave angle with respect to one another.

16. The holder of claim 12, wherein said at least one receptacle is a receptacle selected from the group consisting of a threaded hole, a slide, a track and a through hole.

17. The holder of claim 12, wherein at least one of said two ties comprises a device selected from the group consisting of a clamp and a retainer.

18. The holder of claim 12, further comprising a slanted bracket configured to be secured to said holder by way of said at least one receptacle.

* * * * *